US010259611B2

(12) United States Patent
Grace et al.

(10) Patent No.: US 10,259,611 B2
(45) Date of Patent: Apr. 16, 2019

(54) BLANK, CARTON AND PACKAGE WITH DUAL ACCESS FEATURE

(71) Applicant: Westrock Packaging Systems, LLC, Norcross, GA (US)

(72) Inventors: Michael J. Grace, Richmond, VA (US); Kelly A. Harrigan, Richmond, VA (US); Matthew E. Zacherle, Chesterfield, VA (US); Brandon L. Ramsuer, Henrico, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 15/127,187

(22) PCT Filed: Mar. 19, 2015

(86) PCT No.: PCT/US2015/021487

§ 371 (c)(1),
(2) Date: Sep. 19, 2016

(87) PCT Pub. No.: WO2015/143168

PCT Pub. Date: Sep. 24, 2015

(65) Prior Publication Data

US 2017/0203872 A1 Jul. 20, 2017

Related U.S. Application Data

(60) Provisional application No. 61/955,933, filed on Mar. 20, 2014.

(51) Int. Cl.
*B65D 5/54* (2006.01)
*B65D 5/02* (2006.01)
(Continued)

(52) U.S. Cl.
CPC ..... *B65D 5/542* (2013.01); *B65D 5/02* (2013.01); *B65D 5/4266* (2013.01); *B65D 71/34* (2013.01);
(Continued)

(58) Field of Classification Search
CPC ..... B65D 5/542; B65D 5/02; B65D 5/4266; B65D 71/36
(Continued)

(56) References Cited

U.S. PATENT DOCUMENTS 3,829,006 A * 8/1974 Spiegel ..... B65D 5/542 229/237
4,340,170 A 7/1982 Montealegre
(Continued)

FOREIGN PATENT DOCUMENTS

JP 1994067317 U 9/1994
JP 2010126223 A 6/2010

*Primary Examiner* — Christopher Demeree
(74) *Attorney, Agent, or Firm* — WestRock Intellectual Property Group

(57) ABSTRACT

A carton for packaging one or more articles includes a plurality of panels for forming a top wall, a base wall, a first side wall and a second side wall. The carton includes an access structure for dispensing the one or more articles. The access structure includes a first detachable section, defined by a first series of frangible connections, and a second detachable section, defined by a second series of frangible connections. The first detachable section and second detachable section share a common portion of one of the plurality of panels.

7 Claims, 14 Drawing Sheets

(51) Int. Cl.
*B65D 5/42* (2006.01)
*B65D 71/36* (2006.01)
*B65D 71/34* (2006.01)

(52) U.S. Cl.
CPC ..... *B65D 71/36* (2013.01); *B65D 2571/0045* (2013.01); *B65D 2571/0066* (2013.01); *B65D 2571/00141* (2013.01); *B65D 2571/00444* (2013.01); *B65D 2571/00567* (2013.01); *B65D 2571/00574* (2013.01); *B65D 2571/00728* (2013.01)

(58) Field of Classification Search
USPC .... 229/122, 242, 160.2, 240, 121, 235, 243; 206/427
See application file for complete search history.

(56) References Cited

U.S. PATENT DOCUMENTS

| | | | | |
|---|---|---|---|---|
| 4,396,143 | A | 8/1983 | Killy | |
| 4,417,661 | A | 11/1983 | Roccaforte | |
| 5,505,372 | A * | 4/1996 | Edson | B65D 71/36 229/121 |
| 6,405,921 | B1 * | 6/2002 | Cochrane | A47F 5/112 206/503 |
| 6,866,188 | B2 | 3/2005 | Harrelson | |
| 7,784,676 | B2 * | 8/2010 | Borek | B65D 5/542 229/117.16 |
| 8,061,587 | B2 * | 11/2011 | Blin | B65D 5/542 206/427 |
| 2005/0061865 | A1 | 3/2005 | Marie | |

* cited by examiner

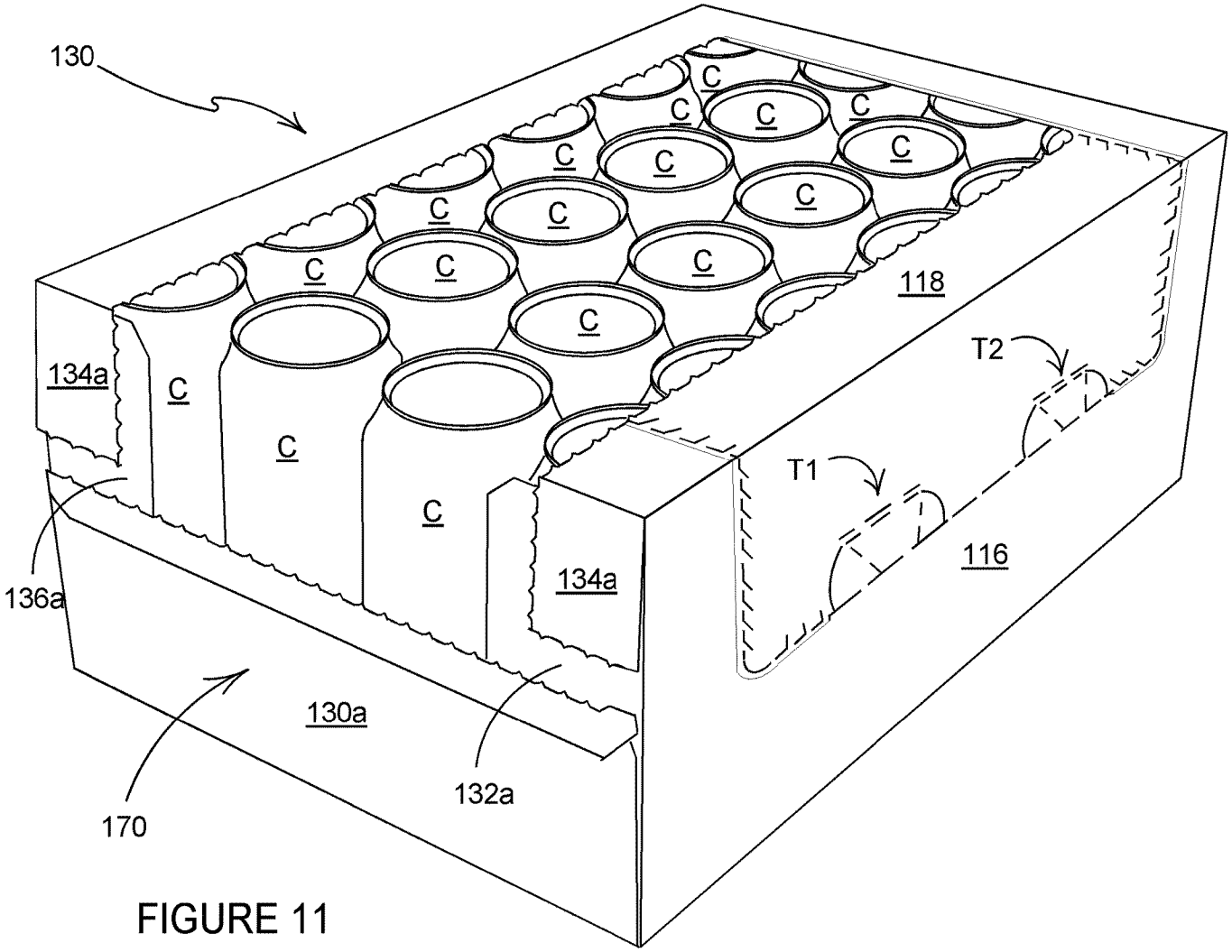
130
134a
136a
C
C
C

BLANK, CARTON AND PACKAGE WITH DUAL ACCESS FEATURE

CROSS-REFERENCE TO RELATED APPLICATIONS

This application is a National Phase application of PCT Application PCT/US15/021487, filed Mar. 19, 2015, which claims the benefit of U.S. Provisional Patent Application No. 61/955,933, filed Mar. 20, 2014, which is incorporated herein by reference in its entirety.

TECHNICAL FIELD

The present invention relates to a blank, to a carton formed from the blank and to a package comprising the carton and articles; more specifically, but not exclusively to an access structure having at least two removable portions sharing at least one common removable portion.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles. When such a multi-pack of articles is obtained, a consumer frequently desires to remove one or more articles and yet retain the remaining articles together within the carton. Thus, it can be appreciated that it is desirable to have a carton with an access structure that facilitates a consumer's access to and removal of articles whilst securely retaining any articles that remain in the carton. Additionally, it is desirable for an access structure to be arranged such that after individual removal of an initial article, the remaining articles are retained within the carton. This is especially important where the articles have a tendency to roll or fall out of an opened carton. However, after the removal of more and more individual articles, it can become difficult to remove the last remaining articles. It is desirable, therefore, to have an access structure that can make the last few remaining articles more accessible. Additionally it is desirable for a carton to be oriented in different ways for users to be able to store the carton, for example in their home refrigerator, and yet at the same time be able to access articles via an access structure.

In one aspect, the present invention seeks to provide an improvement in the field of packaging by providing a new access structure which enables a carton to be placed upon a shelf or other surface in each of two orientations and present an access device in both orientations.

In another aspect the present invention seeks to provide an improvement in the field of packaging by providing a new access structure in which an initial smaller removable portion is disposed within or overlapping at least one larger removable portion, such that a progressively larger access opening can be made.

SUMMARY

According to a first aspect of the invention, there is provided a carton for packaging one or more articles, the carton comprising a plurality of panels for forming a top wall, a base wall, a first side wall and a second side wall, wherein the carton comprises an access structure for dispensing said one or more articles, the access structure comprising a first detachable section, defined by a first series of frangible connections, and a second detachable section, defined by a second series of frangible connections, wherein the first detachable section and the second detachable section share a common portion of one of said plurality of panels.

Optionally, at least one of the first and second detachable sections is struck from a first panel and a second panel, the second panel being disposed adjacent to the first panel.

Optionally, the plurality of panels includes a top wall, a base wall, a first side wall and a second side wall which form a tubular structure, and a first end wall and a second end wall, the first detachable section being struck from a first panel and a second panel, the second panel being disposed adjacent to the first panel and the second detachable section is struck from a third panel and a second panel, the second panel being disposed adjacent to the third panel and the third panel being disposed adjacent to the first panel.

Optionally, the first series of frangible connections and the second series of frangible connections share a common severance line or at least a portion thereof.

Optionally, the access structure comprises at least one tear initiation device for facilitating removal of each of the first and second detachable sections.

According to a second aspect of the invention, there is provided a blank for forming a carton, the blank comprising a plurality of panels for forming a top wall, a base wall, a first side wall and a second side wall in a set-up carton, wherein the blank comprises an access structure for dispensing one or more articles, the access structure comprising a first detachable section, defined by a first series of frangible connections, and a second detachable section, defined by a second series of frangible connections, wherein the first detachable section and the second detachable section share a common portion of one of said plurality of panels.

According to a third aspect of the invention, there is provided a package comprising a carton and a plurality of articles disposed therein and retained therein by the walls of the carton, the package comprising an access structure defined in the carton, the access structure comprising:

(i) a first detachable section defined by a first series of frangible connections; and (ii) a second detachable section defined by a second series of frangible connections, wherein the first detachable section is sufficiently large such that once separated from the carton, one or more articles may be withdrawn from the carton through a first opening thereby created and wherein the first detachable section is disposed entirely within a boundary defined by the second series of frangible connections.

According to a fourth aspect of the invention, there is provided a package comprising a carton and a plurality of articles disposed therein and retained therein by the walls of the carton, the package comprising an access structure defined in the carton, the access structure comprising:

(i) a first detachable section defined by a first series of frangible connections; and (ii) a second detachable section defined by a second series of frangible connections, wherein the first detachable section is sufficiently large such that once separated from the carton, one or more articles may be withdrawn from the carton through a first opening thereby created and wherein the second detachable section has a total area that is greater than the area of the first detachable portion.

Optionally, the second detachable section may have a total area that is greater than the area of the first detachable portion.

Optionally, the second detachable section may have a total area that is at least two times, three times or four times the area of the first detachable portion.

Optionally, the second detachable section may be formed from material comprised in two adjacent walls of the carton and as such the second series of frangible lines may extend into said two adjacent walls of the carton.

Optionally, the frangible lines of the first series of frangible lines are contiguous with one another and wherein the frangible lines of the second series of frangible lines are contiguous with one another.

Optionally, the area of the first detachable portion is between about 5% and about 10% of the area of the carton wall in which it is formed.

Optionally, the first detachable portion may be formed entirely within one carton wall and the second detachable portion may be formed in two adjacent carton walls and the first series of frangible connections may be disposed entirely within the boundary of the second series of frangible connections and a frangible connection of the first series of frangible connections may be coincident with a hinge connection between said two adjacent carton walls.

According to a fifth aspect of the invention for which protection is sought, there is provided a blank for forming a carton having an access structure, the blank comprising a series of hinged panels for forming the walls of the carton and comprising:

(i) a first series of frangible connections defining a first detachable section of the carton; and (ii) a second series of frangible connections defining a second detachable section of the carton;

wherein the first detachable section is sufficiently large such that once separated from the carton formed from the blank, one or more articles to be held by the carton may be withdrawn through a first opening thereby created and wherein the first detachable section is disposed entirely within a boundary defined by the second series of frangible connections.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which:

FIG. 11 is a perspective view from above of the top, first side and first end of a carton formed from the blank of FIG. 8 in which the first removable portion has been detached to provide access to the carton contents;

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the terms "carton" and "carrier" refer, for the non-limiting purpose of illustrating the various features of the invention, to a container for engaging, carrying, and/or dispensing articles, such as cans and bottles. However, it is contemplated that the teachings of the invention can be applied to various containers, which may or may not be tapered and/or cylindrical. Other exemplary articles include bottles (for example metallic, glass or plastics bottles), cans (for example aluminium cans), tins, pouches, packets and the like.

Figure 1:
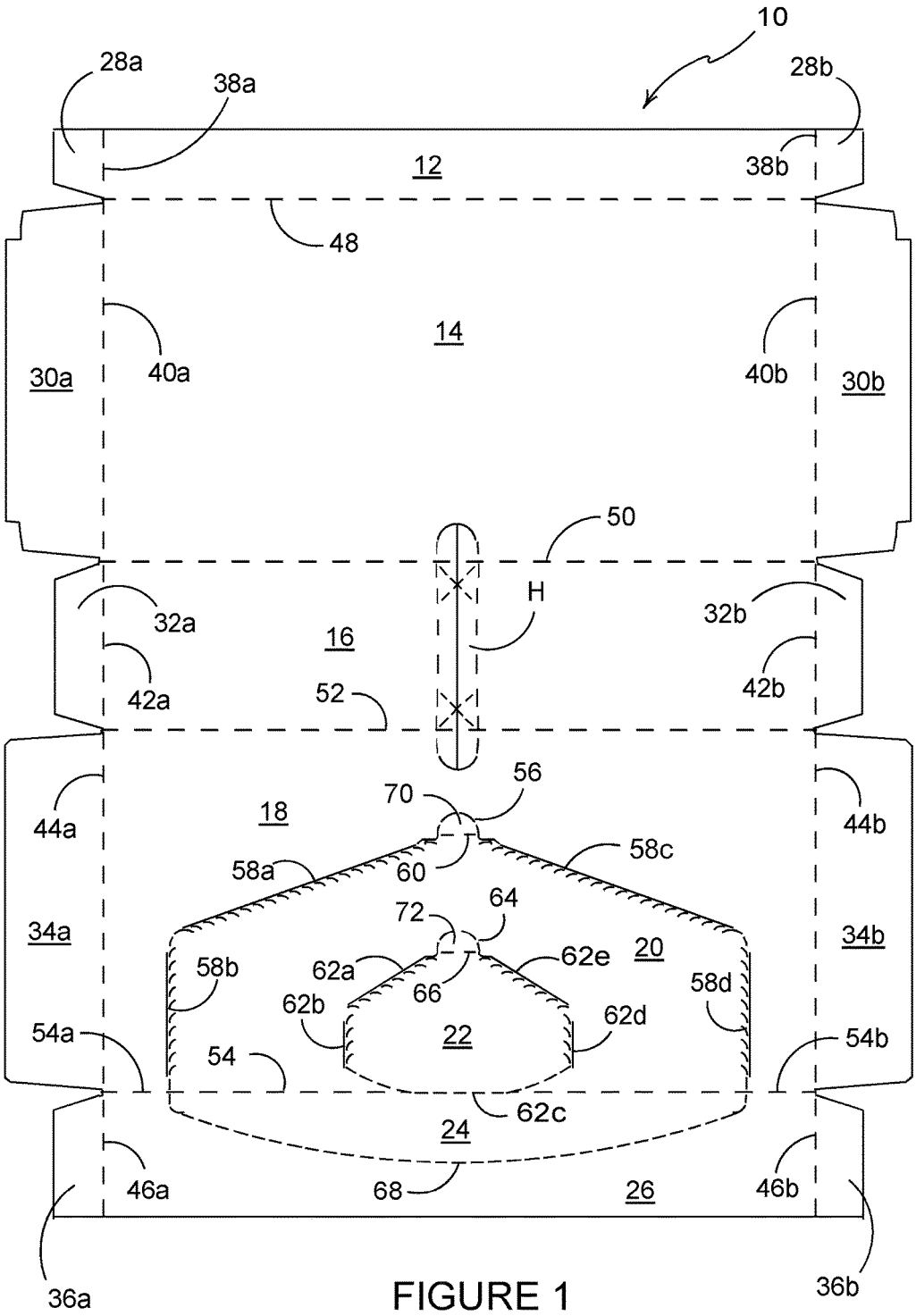
FIG. 1 is a plan view of blank for forming a carton having an access structure according to an embodiment of the invention.

Referring to FIG. 1, there is shown a blank 10 for forming a carton 30 (see FIGS. 2 to 7). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the carton and access structure described in more detail below.

In the exemplary embodiment, the blank 10 is configured to form a carton 30 for packaging an exemplary arrangement of exemplary articles C. In this example, the arrangement is a 4×8 matrix and the articles C are cans. The blank 10 can be alternatively configured to form a carton for packaging other articles and/or different arrangements of articles and articles of different sizes.

Referring to FIG. 1, the blank 10 comprises a series of hinged main panels comprising: a first bottom panel 12, a first side panel 14, a top panel 16, a second side panel 18 and a second bottom panel 26. The main panels 12, 14, 16, 18, 26 are hinged together along hinged connections such as fold lines 48, 50, 52, and 54/54*a*/54*b*. Optionally a carrying handle H is provided in the top panel 16. In this non-limiting exemplary arrangement the carrying handle H is a slot-type carrying handle as is known. In other embodiments it is envisaged that no carrying handle H is provided and in yet other embodiments that a different carrying handle is provided.

End closure panels 28*b*, 30*b*, 32*b*, 34*b*, 36*b*, 28*a*, 30*a*, 32*a*, 34*a*, 36*a* are hinged to each end of the main panels 12, 14, 16, 18, 26 as is shown. More specifically, first bottom end closure panels 28*a*, 28*b* are hinged to each end of the first bottom panel 12 by hinged connection such as fold lines 38*a* and 38*b* respectively. Side end closure panels 30*a*, 30*b*, 34*a*, 34*b* are hinged to each end of the first and second side panels 14, 18 by means of hinged connections such as fold lines 40*a*, 40*b*, 44*a*, 44*b*. Top end closure panels 32*a*, 32*b* are hinged to each end of the top panel 16 by hinged connections such as fold lines 42*a*, 42*b*; and second bottom end closure panels 36*a*, 36*b* are hinged by hinged connections such as fold lines 46*a*, 46*b* to each end of the second bottom panel 26.

An access structure is provided for enabling a user of the carton 30 formed from the blank 10 to gain access to articles C held within the carton 30. The access structure comprises a series of frangible or breakable lines that define removable or detachable sections of the blank 10 or carton 30. Optionally, a first detachable portion 22 is formed within the second side panel 18. Optionally, the first detachable portion 22 is formed wholly within the second side panel 18. The first detachable portion 22 is defined by a contiguous first series of frangible connections comprising frangible lines 62*e*, 62*d*, 62*c*, 62*b*, 62*a* and an initiator 72. In this exemplary arrangement, the initiator 72 is provided to assist a user in grasping or gripping a portion of the first detachable portion 22 to propagate a tear along the frangible connections 62*e*, 62*d*, 62*c*, 62*b*, 62*a* for detaching the first detachable portion 22 from the carton 30 and thereby providing an opening 'fo' into the carton 30, through which articles C held therein may be accessed. The initiator 72 in this optional arrangement is formed by a pull tab 72 that is substantially semi-circular in shape, defined by a weakened connection formed from an alternating series of cuts and connecting nicks 64 and a hinged connection such as a fold line 66. By breaking the weakened connection 64 and folding the pull tab 72 (optionally slightly inwardly of the carton and assisted by the fold line 66), a user may be able to grasp an edge (optionally the edge defined by fold line 66) and, using a finger hooked around that edge, grasp the first detachable portion 22 and pull it to tear or break the frangible lines 62*e*, 62*d*, 62*c*, 62*b*, 62*a*.

A secondary or subsequent preferably larger detachable portion 20/24 is optionally formed in part in the second side wall 18 and in part in the adjacent and connected second bottom panel 26. In other envisaged embodiments, the second detachable portion 20/24 may be formed wholly within a single carton panel. In other envisaged embodiments, the second detachable portion 20/24 may extend into more than two carton panels.

The second detachable portion 20/24 is defined by a second contiguous series of frangible or breakable connections comprising frangible lines 58*a*, 58*b*, 68, 58*d*, 58*c* and an initiator 70.

In this exemplary arrangement, the initiator 70 is the same as the initiator 72 for the initial detachable portion 22. In other envisaged embodiments where two initiators 70, 72 are provided, they are not necessarily the same. The initiator 70 is provided to assist a user in grasping hold of a portion of the second detachable portion 20/24 to propagate a tear along the frangible lines 58*a*, 58*b*, 68, 58*d*, 58*c* for detaching that second detachable portion 20/24 from the carton 30 and thereby providing an opening into the carton 30, through which articles C held therein may be accessed. The initiator 70 in this optional arrangement is formed by a pull tab 70 that is substantially semi-circular in shape, defined by a weakened connection formed from an alternating series of cuts and connecting nicks 56 and a hinged connection such as a fold line 60. By breaking the weakened connection 56 and folding the pull tab 70 (optionally slightly inwardly of the carton and assisted by the fold line 60), a user may be able to grasp an edge (optionally the edge defined by fold line 60) and, using a finger hooked around that edge, grasp the second detachable portion 20/24 and pull it to tear or break of the frangible lines 58*a*, 58*b*, 68, 58*d*, 58*c*.

Figure 3:
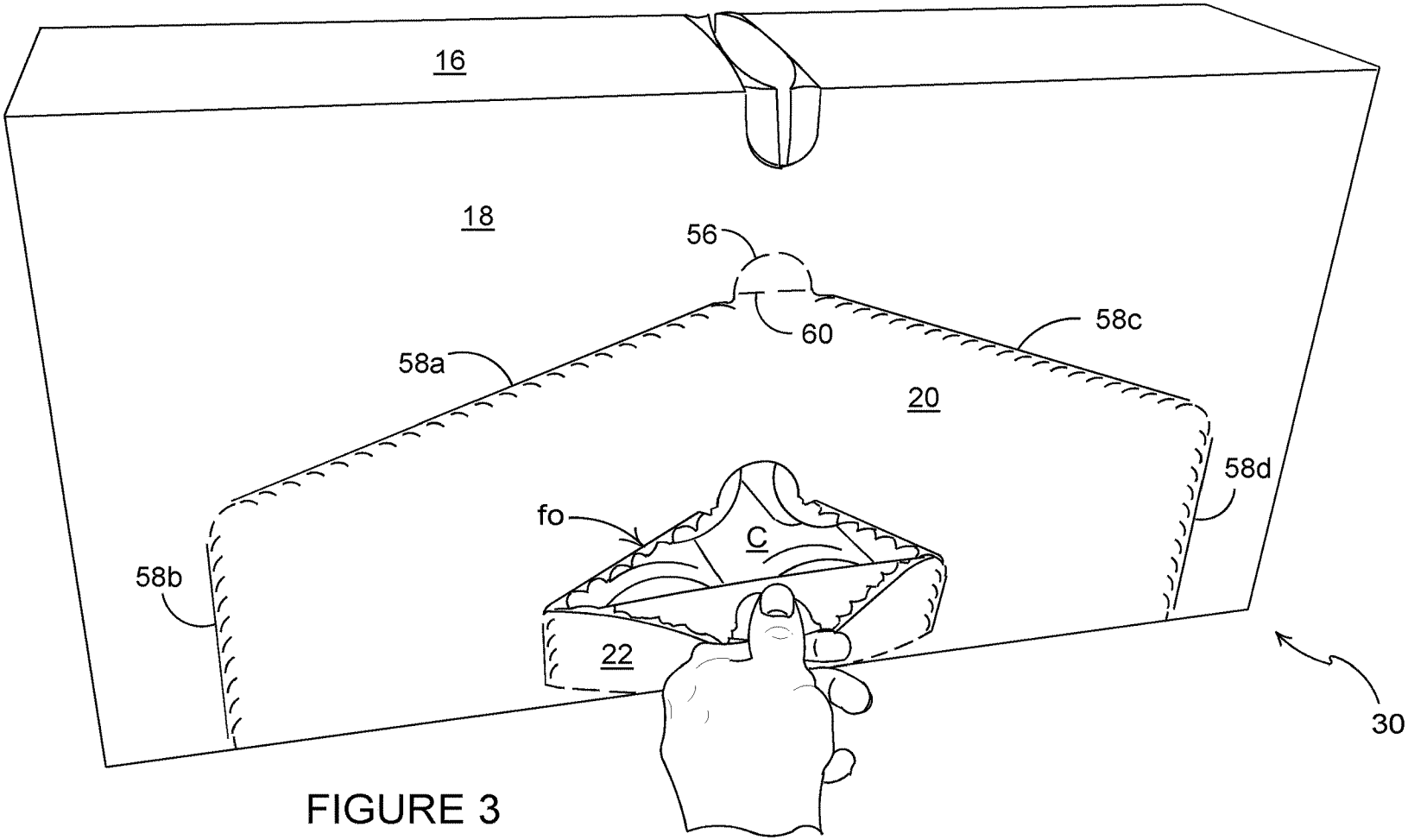
FIG. 3 is a perspective view from above of the top and side of the carton of FIG. 2 wherein a first frangible and detachable portion of an access structure is being removed by a user to gain access to articles disposed within the carton.
Figure 4:
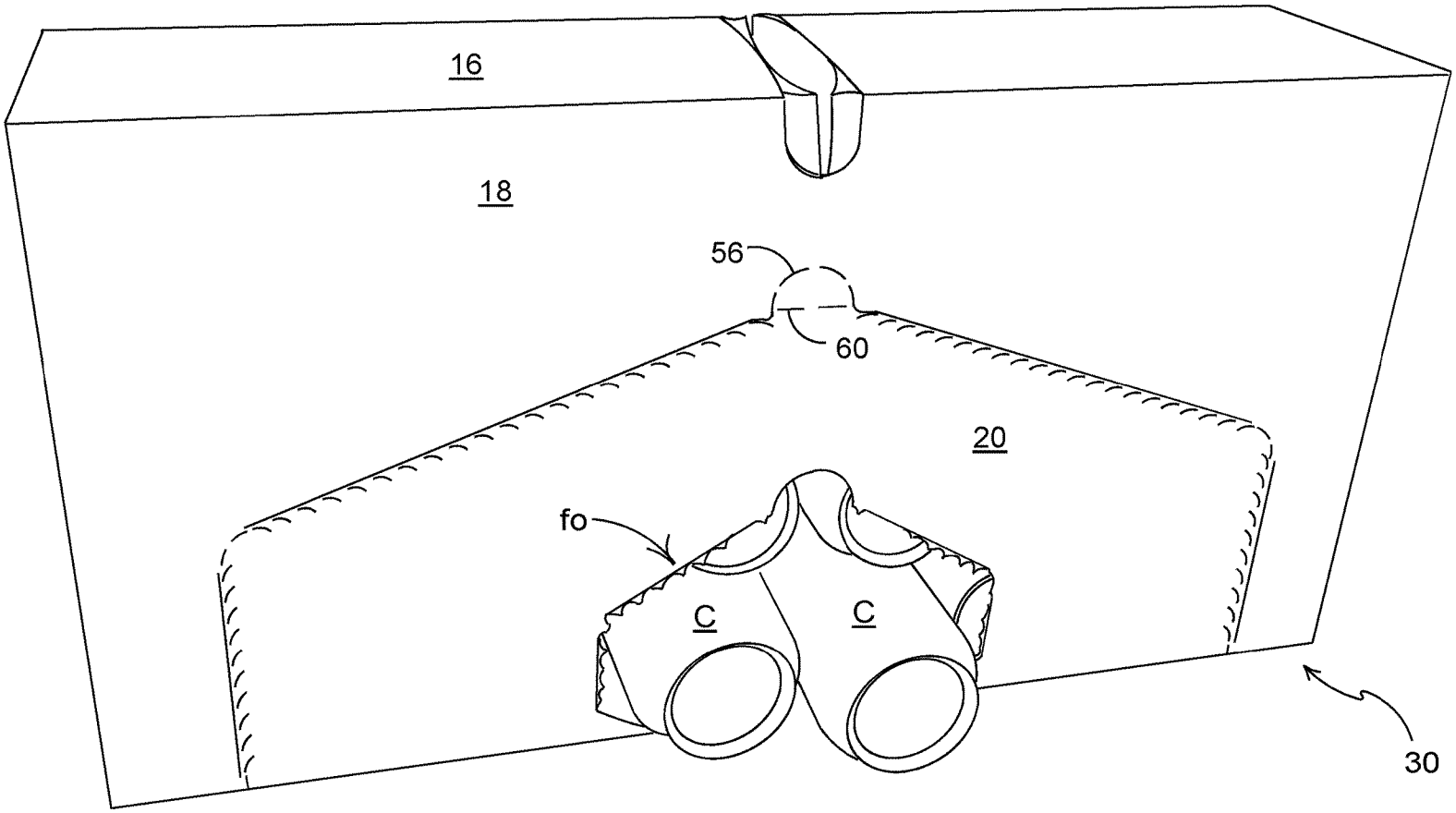
FIG. 4 is a perspective view from above of the top and side of the carton of FIG. 3 wherein the first frangible and detachable portion of an access structure has been fully removed and articles are able to be withdrawn from the carton.
Figure 5:
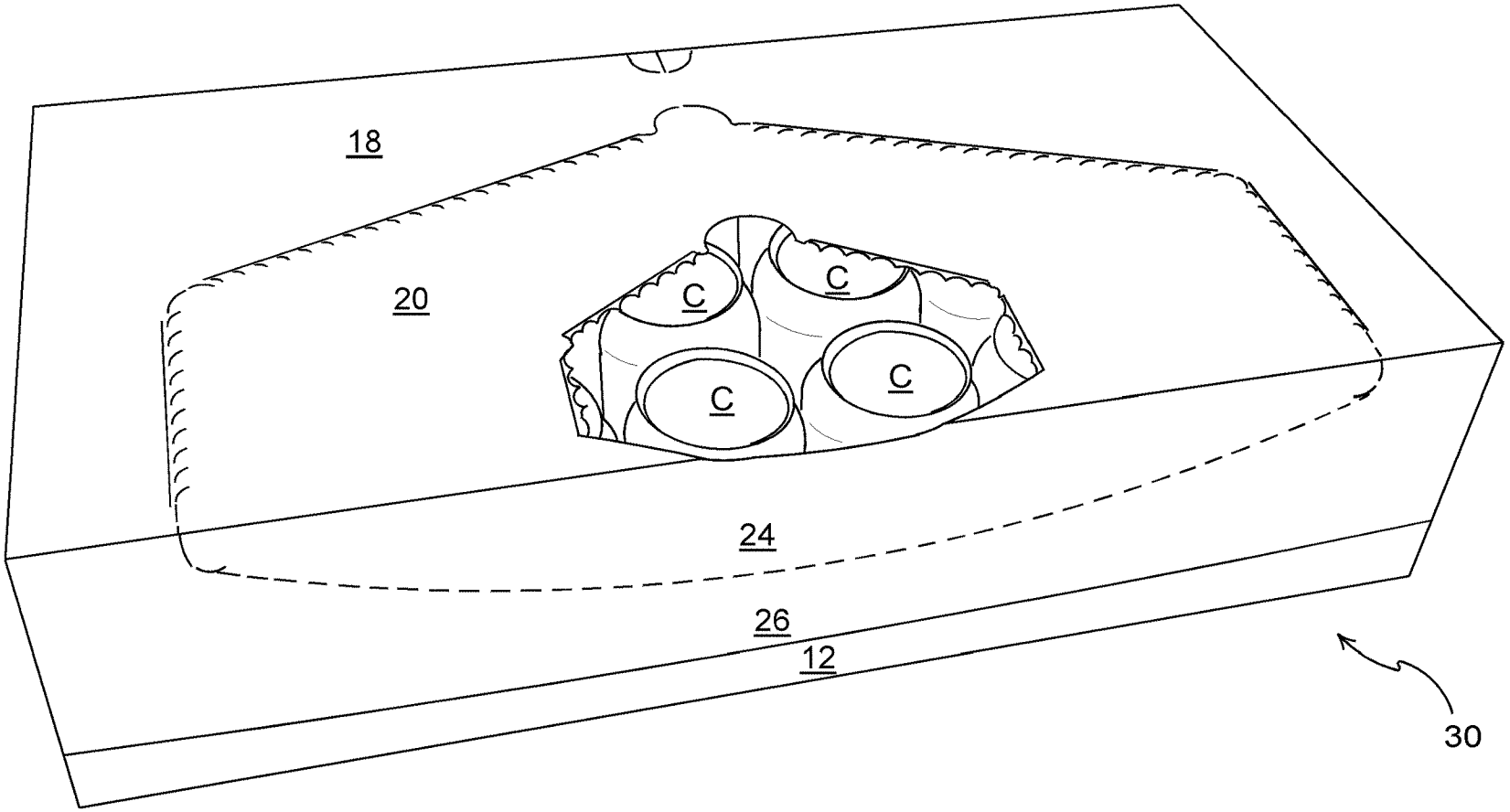
FIG. 5 is a perspective view from above of the side and bottom of the carton of FIG. 4 shown in a different orientation wherein a side wall of the carton is lowermost.
Figure 6:
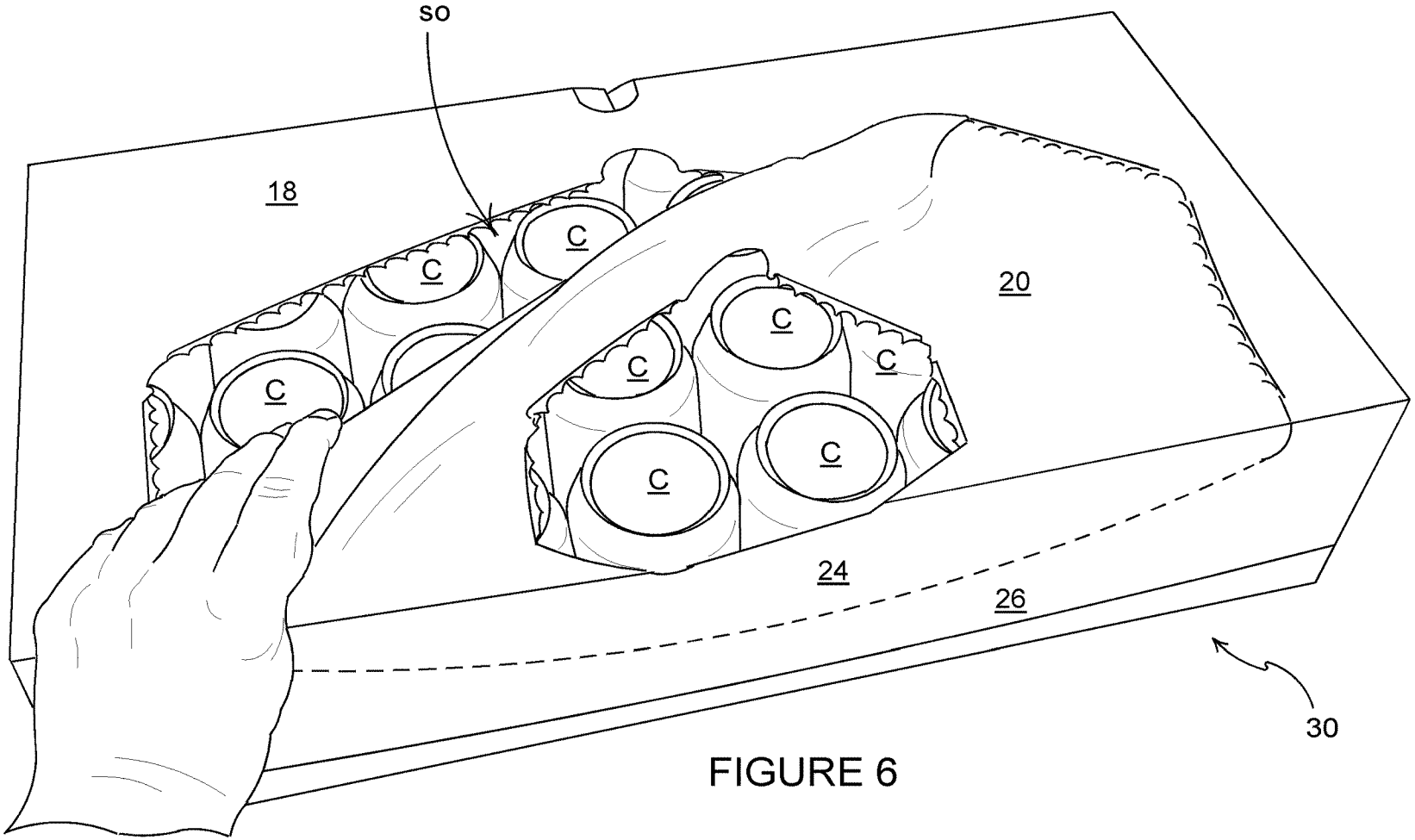
FIG. 6 is a perspective view from above of the carton of FIG. 5 wherein a user is removing a second (subsequent) frangible and detachable portion of an access structure.
Figure 7:
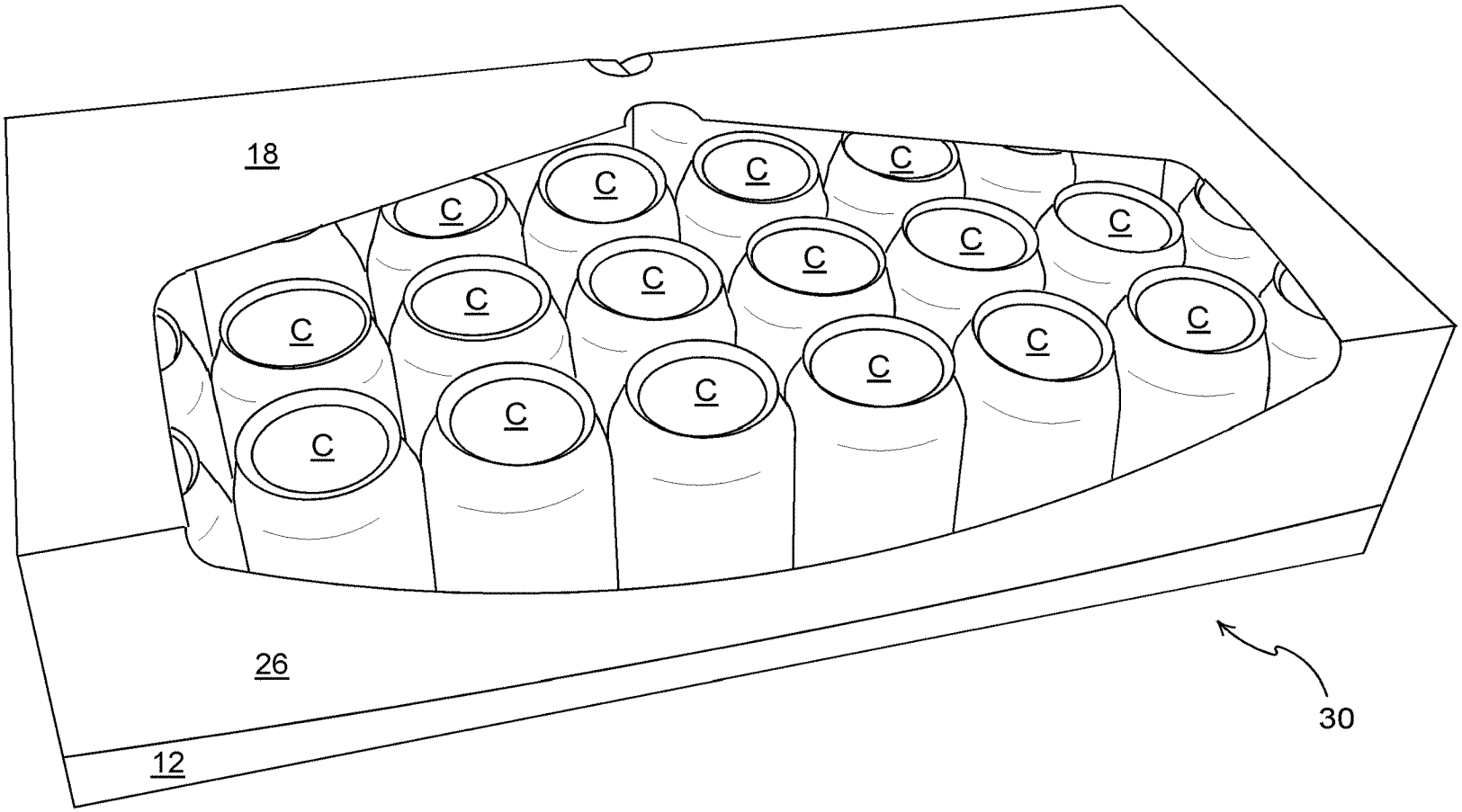
FIG. 7 is a perspective view of the carton of FIG. 6 showing the access structure fully removed.

Optionally, the first detachable portion 22 is sized to enable only one or two articles to be removed through the first opening 'fo' created upon its removal from the carton 30 (see FIGS. 3, 4 and 5). In contrast, the second detachable portion 20/24 is sized and arranged to enable multiple articles, for example two or more and optionally between about 30% and about 60% of the carton's contents, to be removed through the second opening formed upon its removal from the carton 30 (see FIG. 6 and in particular FIG. 7). Optionally, the initial detachable portion 22 is sized and positioned such that it sits entirely within a boundary defined by the frangible lines defining the secondary detachable portion 20/24. Alternatively the first and second detachable portions 22, 20/24 may overlap or may be close together (optionally sharing a frangible connection) such that after removal of the first detachable portion a first opening is formed and then upon removal of the second detachable portion a larger opening is formed. In this way the first and second detachable portions 22, 20/24 provide an access structure that has a progressively larger access opening.

Figure 2:
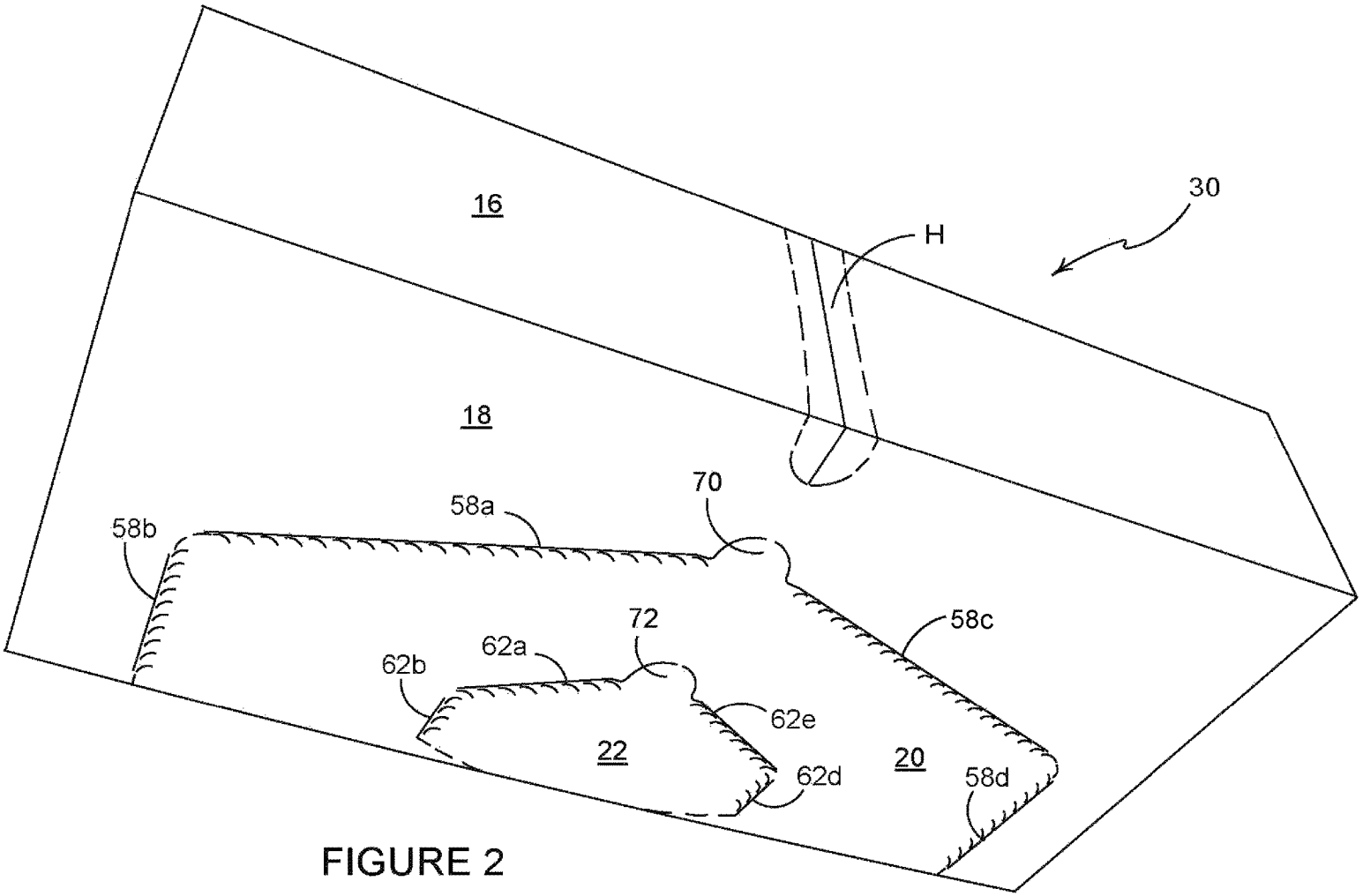
FIG. 2 is a perspective view from above of the top and side of a carton formed from the blank of FIG. 1.

Turning to the construction of the carton 30 as illustrated in FIG. 2 it is envisaged that the carton 30 can be formed by a series of sequential folding operations in a straight line machine so that the carton 30 is not required to be rotated or inverted to complete its construction. The folding process is not limited to that described below and may be altered according to particular manufacturing requirements.

With an inside surface (optionally a non-coated, non-printed surface) of the blank 10 disposed outermost, the first bottom panel 12 may be folded about a hinged connection such as a fold line 48 to bring it into contact with first side panel 14. Affixing means, for example, but not limited to, hot melt adhesive, may be applied to the outer surface of the first bottom panel 12. The blank 10 may then be folded about a hinged connection such as a fold line 52 to being the second side panel 18 into overlaying relationship with the top panel 16 and part of the first side panel 14 and to bring the second bottom panel 26 into overlaying relationship with at least part of the first bottom panel 12 and the affixing means, such that the first and second bottom panels 12/26 are affixed together and form a composite bottom wall of a carton dimensionally similar to the top panel 16. The work product produced from this sequence of folding and gluing steps is a part-formed carton or part-formed blank. In this part-formed and flat condition, the part-formed carton/blank may be shipped to a converting plant, whereat the part-formed carton/blank can be opened out into an open ended tubular structure and loaded from one or both ends with articles, for example cans C.

To contain the articles C within the carton 30 and to complete the formation of the carton 30, the end closure panels 28*b*, 30*b*, 32*b*, 34*b*, 36*b*, 28*a*, 30*a*, 32*a*, 34*a*, 36*a* are folded and affixed to form composite end wall structures that at least partially close each end of the carton 30. In this arrangement, articles C may be loaded when the open-ended tubular carton is disposed upon its first or second side panel 14 or 18 (for example, the orientation shown in FIG. 5). This is so that a known packaging machine can be used, wherein articles C are corralled along their bases and fed into one or both of the open ends until the carton 30 is full with articles C, optionally in a 4×8 matrix. Manipulation of rounded or cylindrical articles positioned on their rolling sides would be more difficult to manage in an automated process. Therefore, it is preferred that the carton 30 is loaded when it is disposed on what has so far been referred to as a first or second side panel 14, 18. With such a panel bottommost, the end walls of the carton are then formed, firstly by folding "bottom" and "top" end closure panels 28*b*/36*b*, 32*b*; 28*a*/36*a*, 32*a* about fold lines 38*b*/46*b*, 42*b*; 38*a*/46*a*, 42*a*, and then by folding up the end closure panels attached to the bottommost panel (in the FIG. 5 orientation this would be first side end closure panels 30*a* and 30*b*), and finally folding down the remaining second side end closure panels 34*a*, 34*b* by folding about fold lines 44*a*, 44*b*. Optionally affixing means, for example, but not limited to, hot melt adhesive, may be applied to the bottommost, first side end closure panels 30*a*, 30*b* and the second side end closure panels 34*a*, 34*b* affixed thereto.

The completed package of carton 30 and articles C is then transported to a sales location where a user may purchase the package. Subsequently, a user then may wish to access the contents C and can deploy the access structure to do so. A user, as described above, can initiate the rupture of at least one of the frangible lines 64, 62*a*, 62*b*, 62*c*, 62*d*, 62*e* defining the first detachable portion 22 by using the pull tab 72. The frangible lines 64, 62*a*, 62*b*, 62*c*, 62*d*, 62*e* may be shaped and directed to assist in the separation of the first detachable portion 22 from the second side panel 18. Optionally, a portion 62*c* of the frangible connection 64, 62*a*, 62*b*, 62*c*, 62*d*, 62*e* defining the first detachable portion 22 may be coincident with a portion 54 of the hinged connection 54/54*a*/54*b* between the second side wall 18 in which the first detachable portion 22 is wholly formed and an adjacent panel, in this example the bottom panel 26. In other envisaged embodiments, no portion of the frangible connection 64, 62*a*, 62*b*, 62*c*, 62*d*, 62*e* defining the initial detachable portion 22 may be coincident with a portion 54 of the hinged connection 54/54*a*/54*b* between the second side wall 18 in which the first detachable portion 22 is wholly formed and an adjacent panel. Where such a coincident portion 62*c* is provided, this may assist in the breaking of the section of the frangible connection 64, 62*a*, 62*b*, 62*c*, 62*d*, 62*e* defining the first detachable portion 22 that is last to break. This is the section disposed opposite the initiating pull tab 72 and by providing the section that is last to break along a hinged connection 54 may make it easier (in other words require less force) to break.

As required by a user, the second detachable portion 20/24 (defined by the series of frangible or breakable lines 58*a*, 58*b*, 68, 58*d*, 58*c* and an initiator 70) may be removed. Optionally, this may be so that the user can access the remaining articles C that are not easily accessible through the first opening 'fo' once the articles C disposed in the region of the first opening 'fo' have been extracted from the carton 30. In this way, the structural integrity of the carton 30 can be preserved while the carton 30 retains a substantial portion of its contents and then, when the quantity of articles C contained therein has been reduced, the second detachable portion 20/24 can be removed allowing a user greater access to the remaining articles C and yet still having a carton 30 that is sufficiently enclosed and strong to restrict or at least mitigate against the unintentional falling out of the remaining articles C from the carton 30.

As is shown in FIG. 4, the first detachable portion 22 has an area defined by the boundary of the frangible lines 64, 62*a*, 62*b*, 62*c*, 62*d*, 62*e*. That area (also referred to as first opening 'fo') may be approximately similar to or slightly greater than the area of (the bases or tops) of three articles C, but shaped such that only two articles C may be withdrawn from the carton 30 at a time (simultaneously). The area of the first detachable portion 22 may be between about 5% and about 10% of the area of the second side panel 18 in which it is formed.

The second detachable portion 20/24 has a total area defined as the area bounded by the frangible lines 56, 58*a*, 58*b*, 68, 58*d*, 58*c* less the area of the first detachable portion 22 bounded by the frangible lines 64, 62*a*, 62*b*, 62*c*, 62*d* and 62*e*.

The second detachable portion 20/24 may also be considered as having a primary area and a secondary area. The primary area is defined as the area 20 of the second detachable portion 20/24 that is disposed in the same second side panel 18 as the first detachable portion 22. The secondary area is defined as the area 24 that is disposed in the adjacent bottom panel 26/12 and which is bounded by frangible line 68 and section 54 of the hinge connection 54/54*a*/54*b* between the two adjacent second side and bottom panels 18 and 26/12.

The area of the first detachable portion 22 may be between about 15% and 30% of the total area of the second detachable portion 20/24 and optionally about 20%. The area of the first detachable portion 22 may be about 25% of the primary area 20 of the second detachable portion 20/24. The secondary area 24 of the second detachable portion 20/24 may be about 20% of the total area of the second detachable portion 20/24 and may optionally be about 50% of the area of the wall in which it is formed (in this case the bottom wall, the area of which is the same as the area of the top wall 16 which, in this example, may be more easily defined and can be defined as the area between fold lines 50, 52, 42*b* and 42*a*).

The total area of the second detachable portion 20/24 may be at least as large as the area of the bases/tops of 15 articles. The primary area of the second detachable portion 20/24 may be between about 45% and about 55% of the area of the second side panel 18, the panel in which the first detachable portion is wholly formed. The total area of the second detachable section may be at least twice the area of the first detachable portion and optionally four times the area of the first detachable portion.

Optionally, the area of the first detachable portion 22 may be linked to the size of the articles C contained therein. More specifically, the area of the first detachable portion 22 may be approximately similar to the area of one article, such that only one article C may be withdrawn from the carton 30 at a time. Alternatively, the area of the first detachable portion 22 may be approximately similar to the area of two articles, and shaped such that two articles C may be withdrawn from the carton 30 at a time.

Optionally, a user may desire to separate the second detachable portion 20/24 before removing any or only some articles C. Separation of the larger second detachable portion 20/24 may be made easier by the removal of the first detachable portion 22. A user could optionally grasp the second detachable portion 20/24 using the first opening 'fo' or using the initiator pull tab 70 provided.

Optionally, the first detachable portion 22 is not wholly defined in a single wall 18 of the carton 30, but rather extends across two adjacent walls 18, 26.

Optionally the second detachable portion 20/24 may be wholly defined in a single panel which may be the same panel 18 in which the first detachable section is formed. A section 68 of the frangible connection 58*a*, 58*b*, 68, 58*d*, 58*c*, 70 that is intended to be broken last and which is disposed opposite to the initiator 70 may optionally be arcuately or curved in shape to assist in the propagation of a tear along that section. As the second detachable portion 20/24 is pulled away from the first side panel 18 starting at tab 70, a break or tear will propagate along the frangible connection 58*a*, 58*b*, 68, 58*d*, 58*c*, 70, assisted by a user pulling on the second detachable portion 20/24 (see FIG. 6) and may sweep across the last to break section 68. It will be understood that the shape, formation and size of each of the first and second detachable portions 22, 20/24 may be altered and reconfigured such that detachable portions can be defined in different styles, sizes and/or shapes of carton.

Referring now to FIGS. 8 to 15, there is shown an alternative embodiment of the present invention. In the second illustrated embodiment, like numerals have, where possible, been used to denote like parts, albeit with the addition of the prefix "100" to indicate that these features belong to the second embodiment. The alternative embodiments share many common features with the first embodiment and therefore only the differences from the embodiment illustrated in FIGS. 1 to 7 will be described in any greater detail.

Figure 8:
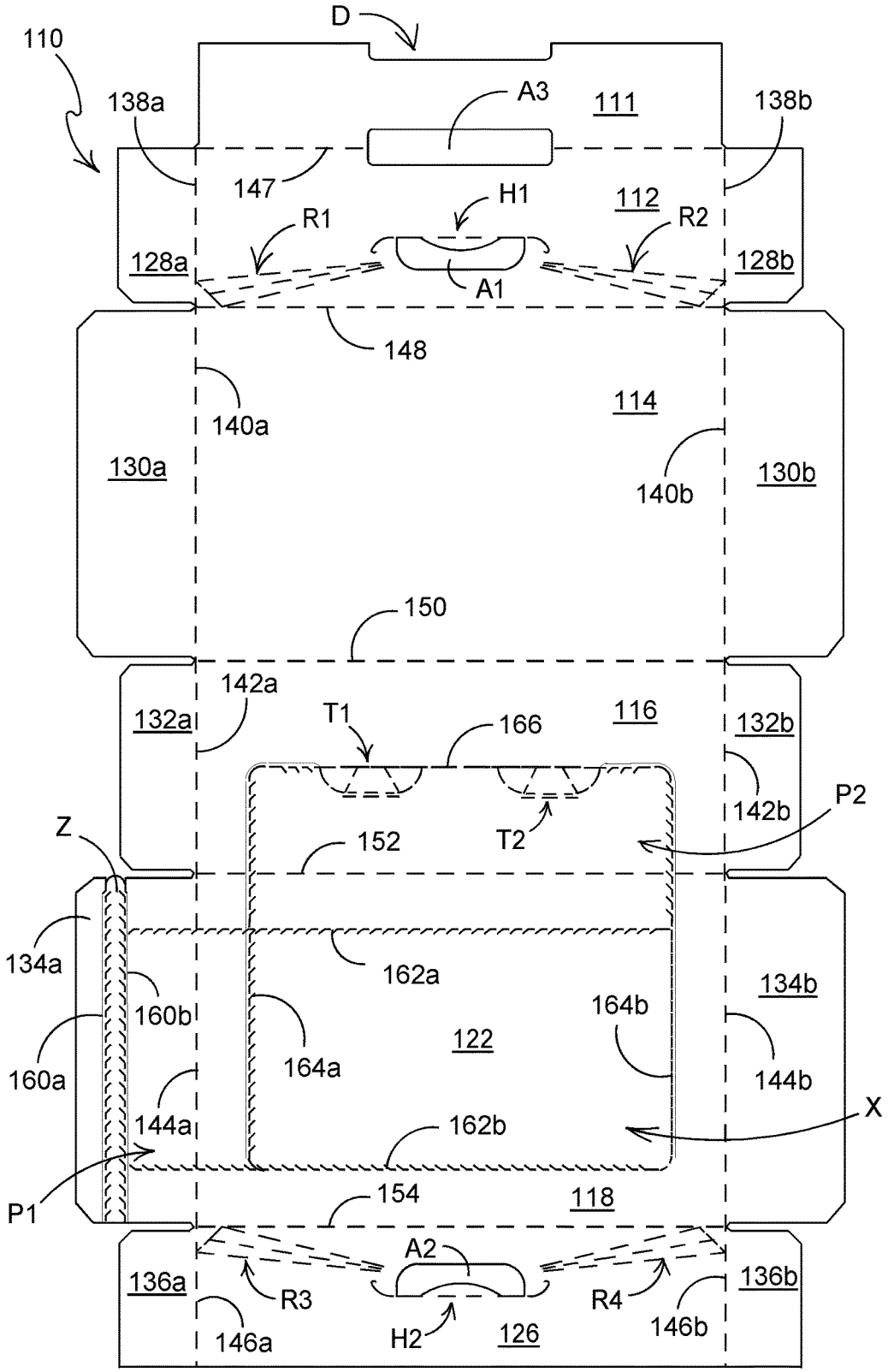
FIG. 8 is a plan view of blank for forming a carton having an access structure according to an embodiment of the invention.

Referring to FIG. 8, there is shown a blank 110 for forming a carton 130. In the second illustrated embodiment, the blank 110 is configured to form a carton 130 for packaging an exemplary arrangement of exemplary articles C. In this example, the arrangement is a 4×6 matrix and the articles C are cans. The blank 110 can be alternatively configured to form a carton for packaging other articles and/or different arrangements of articles and articles of different sizes.

The blank 110 comprises a series of hinged main panels comprising: a handle reinforcing panel 111, a first lower side panel 112, a bottom panel 114, a second side panel 116, a top panel 118, and a first upper side panel 126. The main panels 111, 112, 114, 116, 118, 126 are hinged together along hinged connections such as fold lines 147, 148, 150, 152, and 154 respectively.

End closure panels 128*b*, 130*b*, 132*b*, 134*b*, 136*b*, 128*a*, 130*a*, 132*a*, 134*a*, 136*a* are hinged to each end of the main panels 112, 114, 116, 118, 126 as is shown. More specifically, first lower side end closure panels 128*a*, 128*b* are hinged to each end of the first lower side panel 112 by hinged connections such as fold lines 138*a* and 138*b* respectively.

Bottom end closure panels 130*a*, 130*b* are hinged to each end of the bottom panel 114 by means of hinged connections such as fold lines 140*a*, 140*b*. Second side end closure panels 132*a*, 132*b* are hinged to each end of the second side panel 116 by hinged connections such as fold lines 142*a* and 142*b* respectively. Top end closure panels 134*a*, 134*b* are hinged to each end of the top panel 118 by hinged connections such as fold lines 144*a*, 144*b*; and first upper side end closure panels 136*a*, 136*b* are hinged by hinged connections such as fold lines 146*a*, 146*b* to each end of the first upper side panel 126.

Optionally, a carrying handle H1/H2 is provided in part in the first lower side panel 112 and in part in the first upper side panel 126. In this non-limiting exemplary arrangement the carrying handle H1/H2 is formed from a pair of apertures A1, A2. A first aperture A1 is struck from the first lower side panel 112. A second aperture A2 is struck from the first upper side panel 126. The first aperture A1 and the second aperture A2 are arranged such that when the first lower side panel 112 and first upper side panel 126 are arranged in partially overlapping relationship with one another, a handle grip is defined between first and second apertures A1, A2. The carrying handle H1/H2 comprises a pair of cushioning flaps. A first cushioning flap is hinged to the first lower side panel 112 and a second cushioning flap is hinged to the first upper side panel 126. The first and second cushioning flaps each define a portion of the respective one of the first and second apertures A1, A2. The first lower side panel 112 comprises a pair of relief structures R1, R2. A first relief structure R1 extends between the first aperture A1 and the vertex between fold line 138*a* and fold line 148. A second relief structure R2 extends between the first aperture A1 and the vertex between fold line 138*b* and fold line 148. The first upper side panel 126 comprises a pair of relief structures R3, R4. A third relief structure R3 extends between the second aperture A2 and the vertex between fold line 146*a* and fold line 154. A fourth relief structure R4 extends between the second aperture A2 and the vertex between fold line 146*b* and fold line 154. Each of the first, second, third and fourth relief structures R1, R2, R3, R4 comprises three divergently arranged fold lines extending from a location proximate the first or second apertures A1, A2. The three divergently arranged fold lines terminate proximate the respective vertex defining a corner of the first side panel 112/126. The three divergently arranged fold lines terminate at a cut line or weakened line of severance which cut line or weakened line of severance extends between the pair of fold lines defining the respective vertex or corner of the first side panel 112/126.

Optionally, the blank comprises a handle reinforcing panel 111 hinged to the first lower side panel 112 by a hinged connection such as a fold line 147. An aperture A3 is struck in part from the first lower side panel 112 and in part from the handle reinforcing panel 111. Aperture A3 interrupts fold line 147. A cutaway or recess D is provided in the handle reinforcing panel 111 in a free side edge opposing the fold line 147. The aperture A3 and the recess D are arranged to be in vertical registry with the first and second apertures A1, A2.

In other embodiments it is envisaged that the carrying handle H is omitted and in yet other embodiments that a different carrying handle is provided.

An access structure X is provided for enabling a user of the carton 130 formed from the blank 110 to gain access to articles C held within the carton 130. The access structure X comprises a series of frangible or breakable lines that define removable or detachable sections of the blank 110 or carton 130.

A first removable portion P1 is defined in part by a first weakened line of severance 162*a* and in part by a second weakened line of severance 162*b*. The first weakened line of severance 162*a* and the second weakened line of severance 162*b* extend longitudinally across the top panel 118 and into the top end closure panel 134*a*.

A second removable portion P2 is defined in part by a third weakened line of severance 164*a* and in part by a fourth weakened line of severance 164*b*. The third weakened line of severance 164*a* and the fourth weakened line of severance 164*b* extend transversely across the top panel 118 and into the second side panel 116.

Optionally, the third weakened line of severance 164*a* and the fourth weakened line of severance 164*b* are arranged to be perpendicular with respect to the first weakened line of severance 162*a* and the second weakened line of severance 162*b*.

The first removable portion P1 is defined in part by a portion of fourth weakened line of severance 164*b*.

The second removable portion P2 is defined in part by a portion of the second weakened line of severance 162*b*.

The first removable portion P1 is defined in part by a portion of a fifth weakened line of severance 160*b*. The fifth weakened line of severance 160*b* forms part of a tear initiation device in the form of a tear strip Z. The tear initiation device comprises sixth weakened line of severance 160*a*. The fifth weakened line of severance 160*b* and sixth weakened line of severance 160*a* are arranged substantially in parallel to one another. The fifth weakened line of severance 160*b* and sixth weakened line of severance 160*a* each extends transversely across the top end closure panel 134*a*. The tear strip Z divides the top end closure panel 134*a* into two parts, an upper removable part forming part of the first removable portion P1 and a lower securing part for being secured in overlapping relationship with the bottom end closure panel 130*a*. The first weakened line of severance 162*a* and the second weakened line of severance 162*b* each terminate at the fifth weakened line of severance 160*b*.

The second removable portion P2 is defined in part by a seventh weakened line of severance 166.

A pair of tear initiation devices T1, T2 is provided in the second side panel 116. Each of the tear initiation devices T1, T2 interrupts the seventh weakened line of severance 166. Each of the tear initiation devices T1, T2 comprises a severance line which is collinear with the seventh weakened line of severance 166. Each of the tear initiation devices T1, T2 are further defined by a pair of arcuate severance lines. The pair of arcuate severance lines intersect with the seventh weakened line of severance 166. A fold line is disposed between the arcuate severance lines so as to couple a first arcuate severance line to a second arcuate severance line. The severance line, the pair of arcuate severance lines and the fold line define a tab. The tab is optionally hinged to the second removable portion P2 and optionally struck therefrom.

Figure 9:
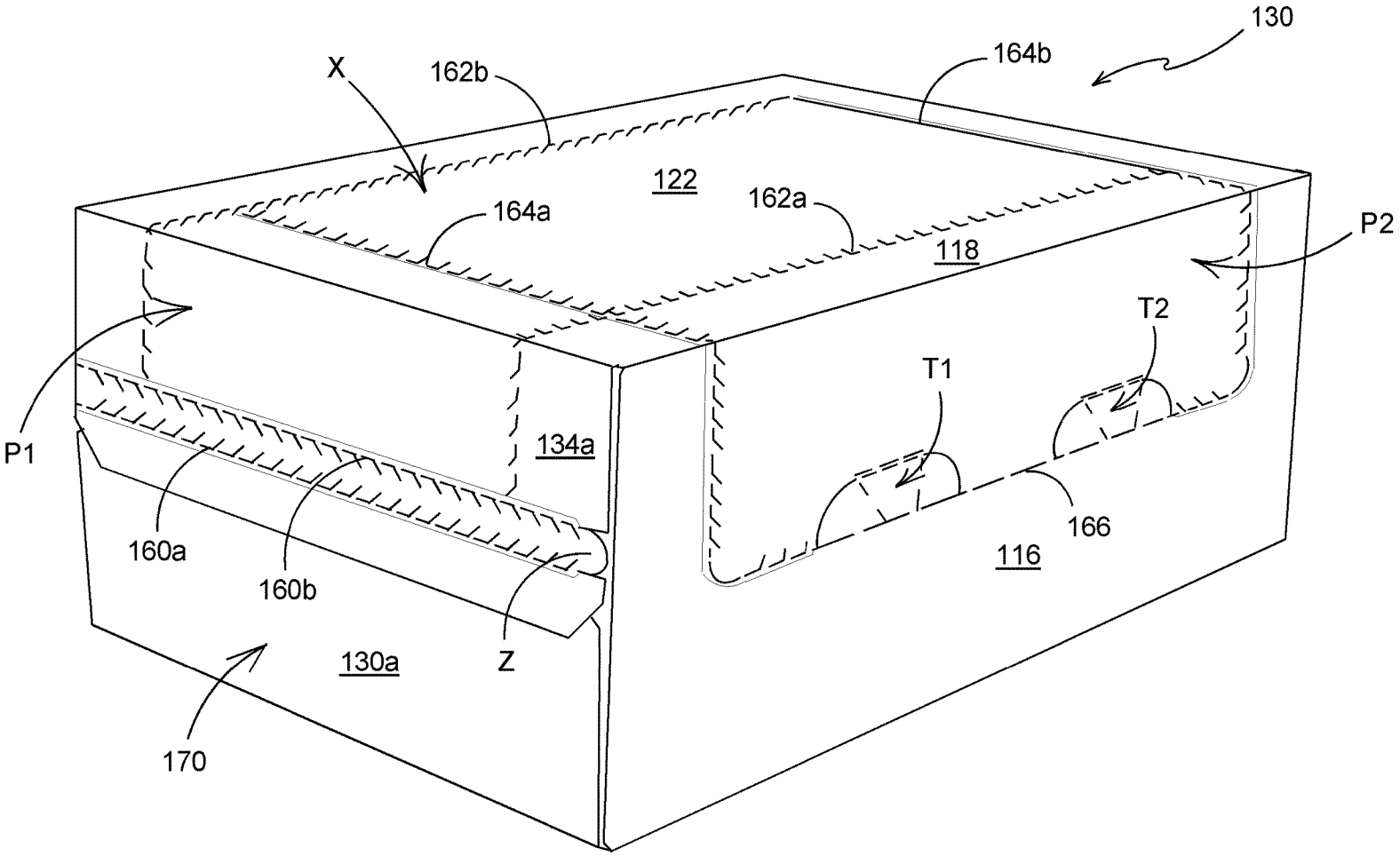
FIG. 9 is a perspective view from above of the top, first side and first end of a carton formed from the blank of FIG. 8.

FIG. 9 illustrates a carton 130 formed from the blank 110 of FIG. 8. The carton 130 can be formed by a series of sequential folding operations in a straight line machine so that the carton 130 is not required to be rotated or inverted to complete its construction. The folding process is not limited to that described below and may be altered according to particular manufacturing requirements.

Glue or other adhesive treatment is applied to the handle reinforcing panel 111 or, in alternative embodiments, to a corresponding portion of the first lower side panel 112.

The blank 110 is folded about fold line 147 such that the handle reinforcing panel 111 is brought into face contacting relationship with an inside surface of the first lower side panel 112. The handle reinforcing panel 111 is secured to the first lower side panel 112.

The blank 110 is folded about a hinged connection such as a fold line 148, such that the handle reinforcing panel 111 and the first lower side panel 112 are folded together thereabouts. The handle reinforcing panel 111 and the first lower side panel 112 are folded such that an inside surface of the handle reinforcing panel 111 is brought into face contacting relationship with an inside surface of the base panel 114.

Glue or other adhesive treatment is applied to an inside surface of the first upper side panel 126 or, in alternative embodiments, to a corresponding portion of an outer surface of the first lower side panel 112.

The top panel 118 and first upper side panel 126 are folded about the fold line 152 such that the top panel 118 overlaps with the second side panel 116. The first upper side panel 126 is brought into at least partial overlapping relationship with the first lower side panel 112.

The first upper side panel 126 is secured to the first lower side panel 112, to form a composite side panel 126/112; in this way a flat collapsed carton is formed. The carton 130 may be shipped or distributed in this flat collapsed form. Optionally, each of the first lower side end closure panels 128*a*, 128*b* are secured to the respective one of the first upper side end closure panels 136*a*, 136*b* to form composite side end closure panels 128*a*/136*a*, 128*b*/136*b*.

In alternative embodiments the first upper side panel 126 may be secured to the first lower side panel 112 by alternative securing means for example, but not limited to, staples or other mechanical fixing means.

The flat collapsed carton may be erected into a tubular structure by separating the top panel 118 from the base panel 114.

The carton 130, in its open ended tubular form, may be loaded with articles through one or both open ends. It will be appreciated that in other embodiments one of the open ends of the carton 130 may be closed before loading the carton 130 with articles through the remaining open end.

In some embodiments, some or all of the end closure panels may be folded outwardly so as to create a funnel at the open end of the tubular structure for facilitating loading of the carton with articles.

Once the carton 130 is loaded with articles C the ends of the tubular structure are closed.

A first end of the tubular structure is closed by folding a first side end closure panel 128*a*/136*a* about fold lines 138*a*, 146*a*. A second side end closure panel 132*a* is folded about fold line 142*a*.

Glue or other adhesive treatment may be applied to the first side end closure panel 128*a*/136*a* or in alternative embodiments to a corresponding portion of the bottom end closure panel 130*a*.

Glue or other adhesive treatment may be applied to the second side end closure panel 132*a* or in alternative embodiments to a corresponding portion of the bottom end closure panel 130*a*.

The bottom end closure panel 130*a* is then folded about the fold line 140*a* to be brought into contact with the first side end closure panel 128*a*/136*a* and the second side end closure panel 132*a* and is optionally secured thereto.

Glue or other adhesive treatment is applied to the bottom end closure panel 130*a* or in alternative embodiments to a corresponding portion of the top end closure panel 134*a*.

The top end closure panel 134*a* is then folded about the fold line 144*a* to be brought into contact with the bottom end closure panel 130*a*.

A second end of the tubular structure is closed by a method substantially similar to that described above in relation to the first end of the carton 130.

The carton 130 shown in FIG. 9 comprises an access structure X; the access structure X comprises two removable portions P1, P2; a first removable portion P1 and a second removable portion P2. The first removable portion P1 and the second removable portion P2 share a common portion 122.

Figure 10A:
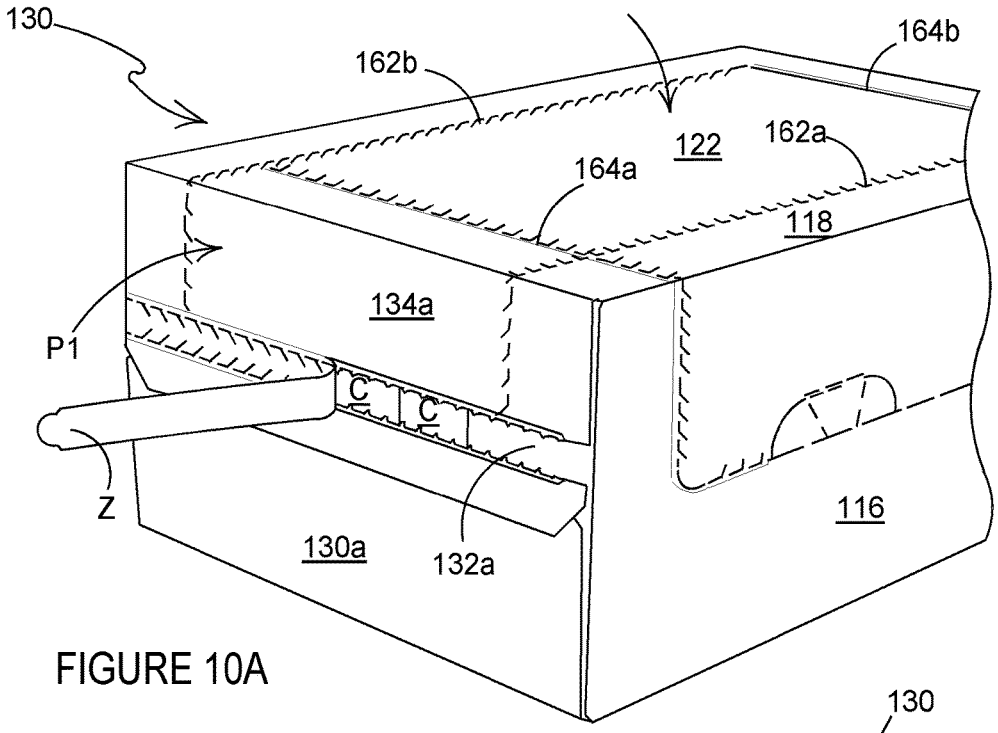
FIGS. 10*a* and 10*b* are perspective views from above of stages in the removal of a first removable portion of an access device.
Figure 10B:
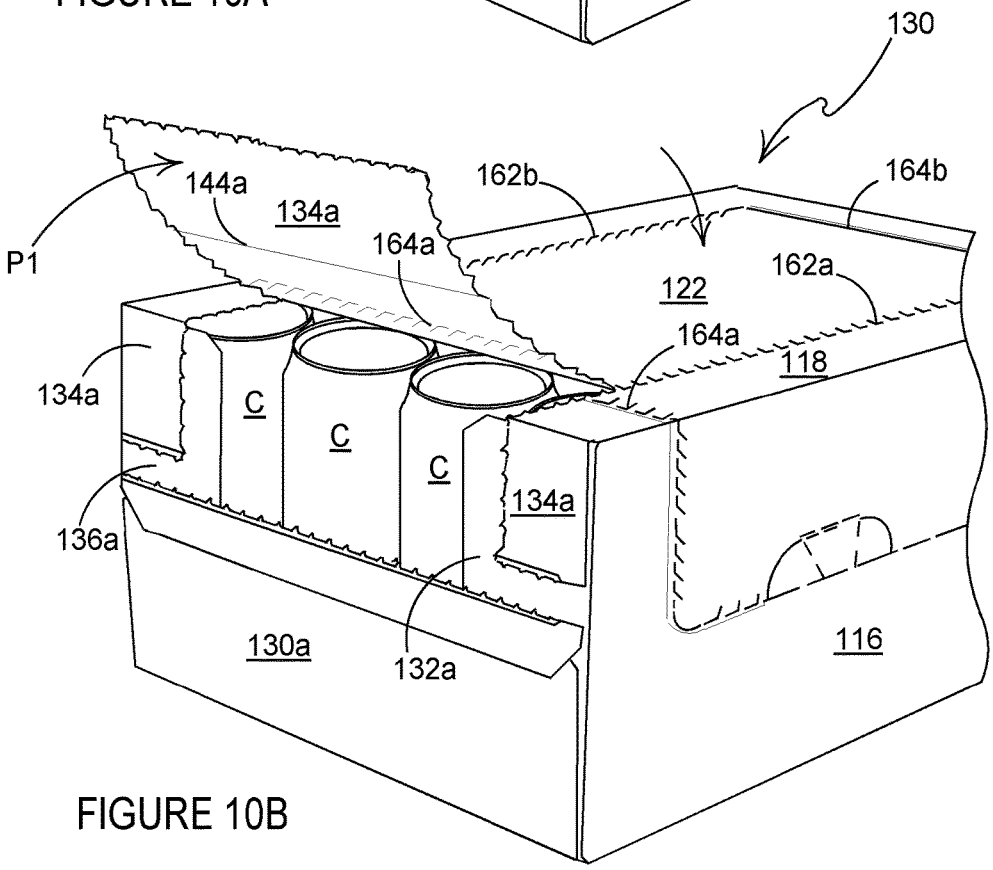

FIGS. 10A, 10B and 11 show deployment of the access structure X to remove the first removable portion P1 from the carton 130 so as to form an opening in the top panel 118 and a first composite end panel 170 formed from the end closure panels 128*a*, 130*a*, 132*a*, 134*a*, 136*a*. FIG. 10A shows the tear strip Z being removed by severing the fifth weakened line of severance 160*b* and sixth weakened line of severance 160*a*. Removal of the tear strip Z provides a user with access to an edge of the first removable portion P1 and creates a slot or aperture in the end panel of the carton 130. In FIG. 10B the tear strip Z has been removed and the first removable portion P1 has been partially torn from the carton 130; a tear has propagated along a portion of each of the first and second weakened lines of severance 162*a*, 162*b*. FIG. 11 shows the carton 130 in which the first removable portion P1 has been detached from the carton 130 to provide an opening through which the contents C of the carton 130 can be accessed.

Figure 12:
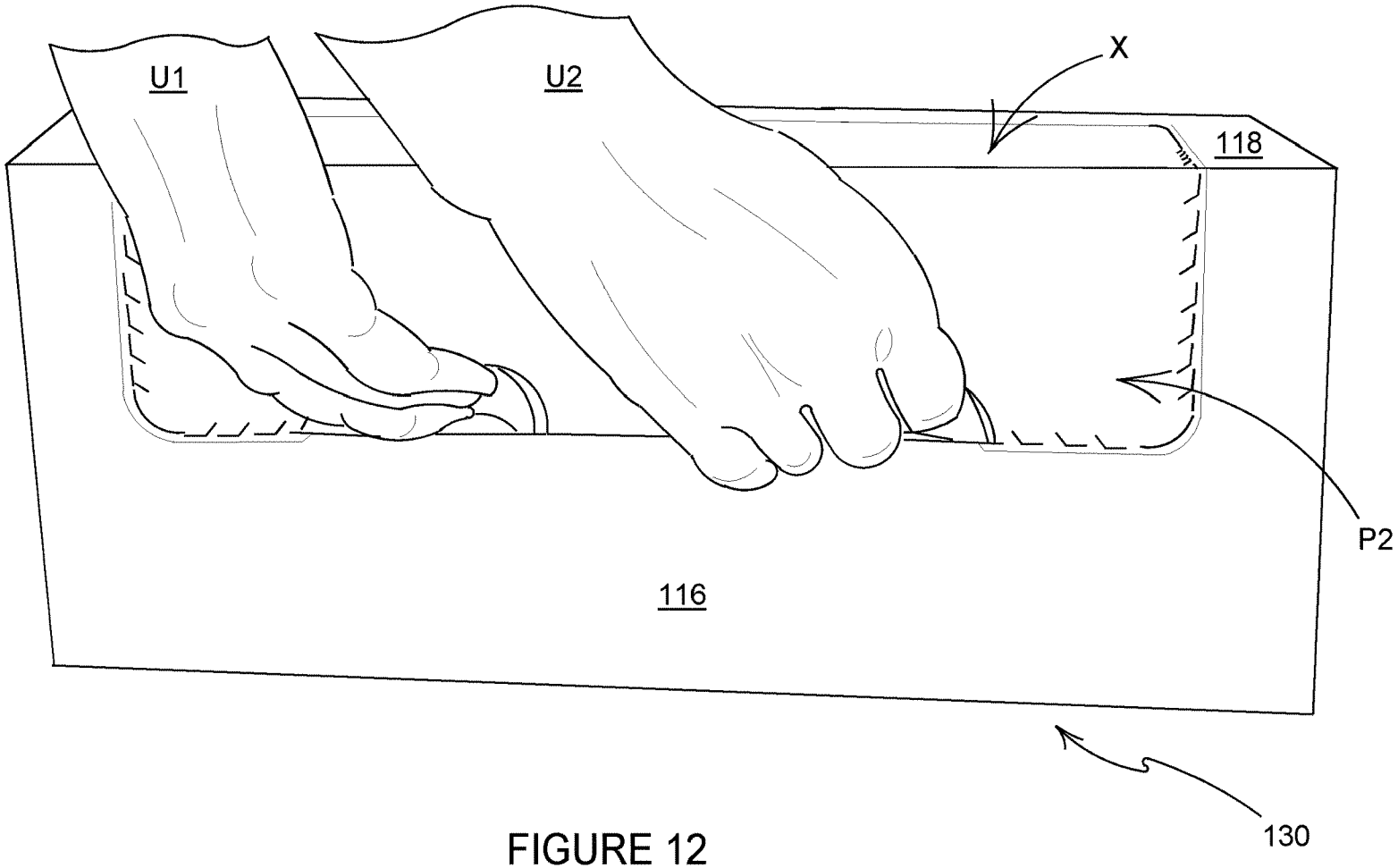
FIGS. 12 and 13 are perspective views from above of stages in the removal of a second removable portion of an access device.
Figure 13:
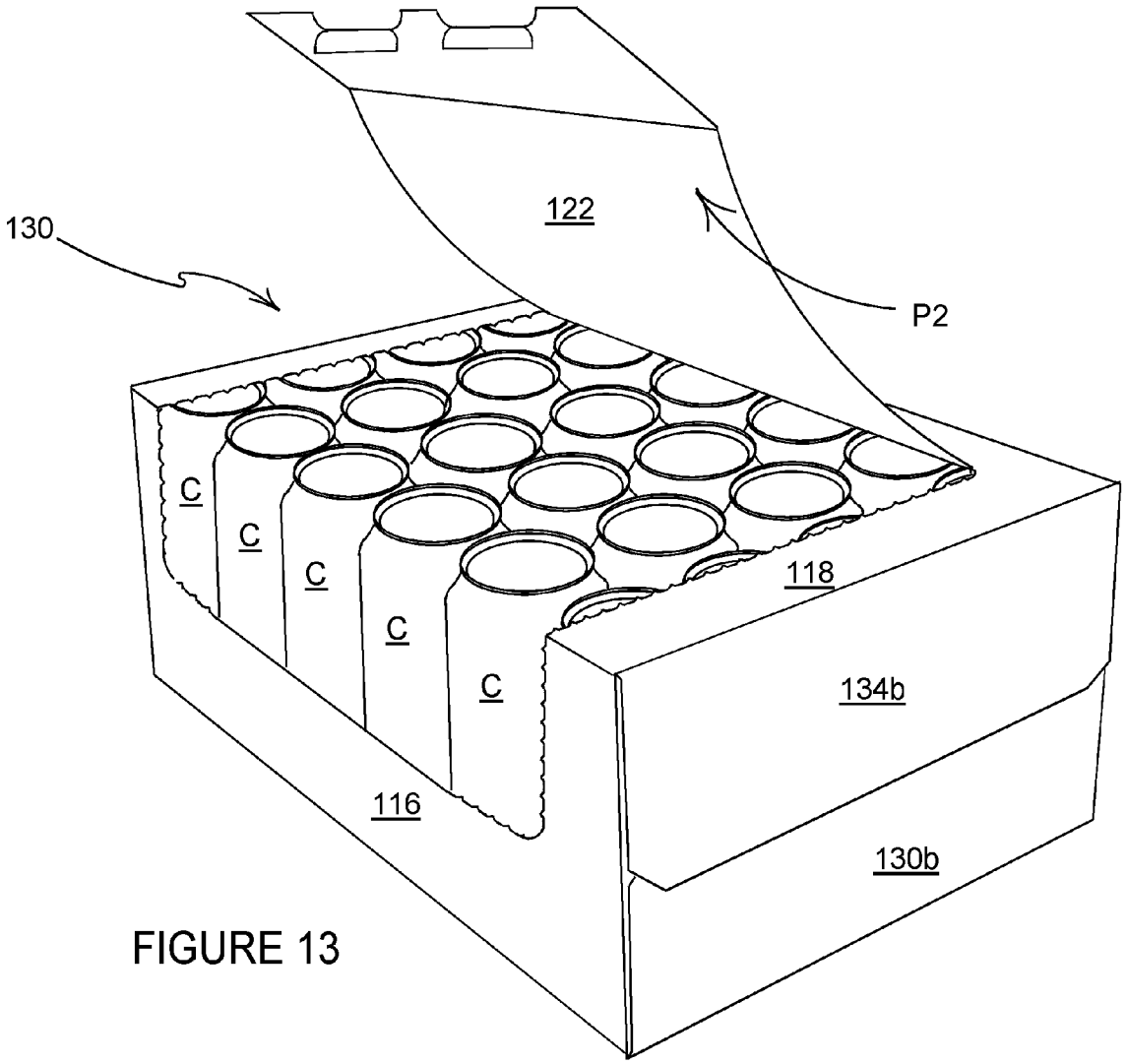
Figure 14:
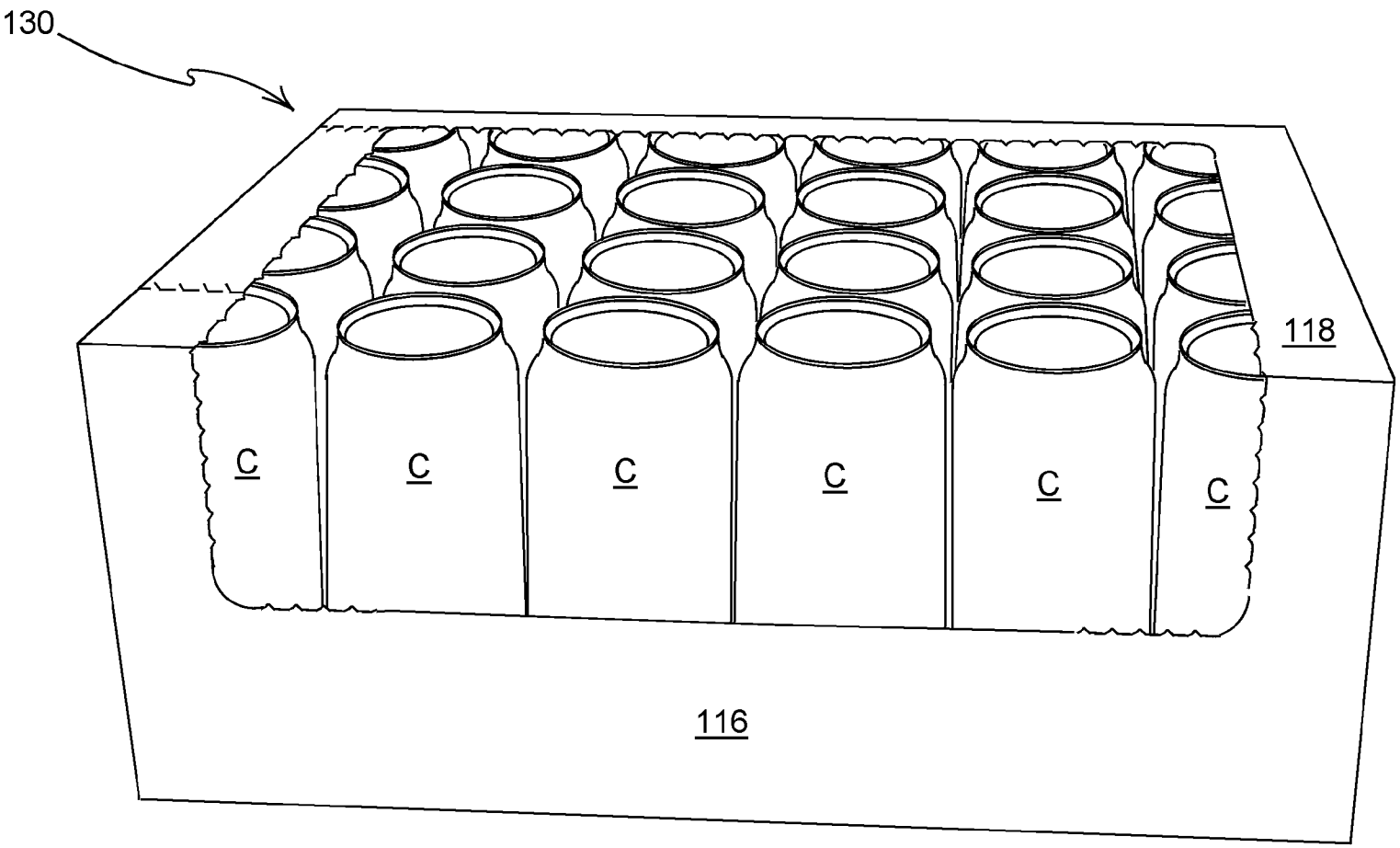
FIG. 14 is a perspective view from above of the top, first side and first end of a carton formed from the blank of FIG. 8 in which the second removable portion has been detached to provide access to the carton contents.

FIGS. 12, 13 and 14 show deployment of the access structure X to remove the second removable portion P2 from the carton 130 so as to form an alternative opening; the opening is formed in the top panel 118 and the second side panel 116. FIG. 12 shows a user U1/U2 engaging with the tear initiation devices T1, T2. The tear initiation devices T1, T2 facilitate removal of the second removable portion P2; the tear initiation devices T1, T2 each provide a weakened region such that a user may readily create apertures in the carton 130 so as to grasp the second removable portion P2. In FIG. 13 a tear has propagated along a portion of each of the third and fourth weakened lines of severance 164*a*, 164*b*. FIG. 14 shows the carton 130 in which the second removable portion P2 has been detached from the carton 130 to provide an opening through which the contents C of the carton 130 can be accessed.

In this way the access structure X provides that the carton 130 can be placed in two alternative orientations with respect to a user or shelf or other surface, and access may be readily gained to the carton contents in either orientation.

It can be appreciated that various changes may be made within the scope of the present invention. For example, the size and shape of the panels, detachable sections and frangible connections may be adjusted to accommodate articles of differing size or shape.

In other embodiments it is envisaged that part of the frangible boundary of the first detachable portion 22 may be co-incident with a part of the boundary of the second detachable portion 20/24. In other embodiments it is envisaged that the first detachable portion extends across two adjacent panels. In other embodiments it is envisaged that the first detachable portion is not wholly formed within the boundary of the second detachable portion, but that the two detachable portions overlap or abut, optionally such that only a portion of the first detachable portion 20 is within the boundary defined by the second series of frangible lines that define the second detachable portion and another portion of the first detachable portion 20 is outside of the boundary defining the second detachable portion 20/24. Nevertheless, in such an arrangement, the first detachable portion is optionally sized to enable the withdrawal of at least one article from the package and the second detachable portion is larger in area than the first detachable portion. In such an arrangement, the second detachable portion may be removed as more than one section after the removal of the first detachable portion. Step-wise removal of the first and then the second detachable portions progressively results in the creation of a single larger access opening.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the terms "weakened line of severance", "severance line" and "frangible line" each may refer to all manner of lines formed in the blank or substrate of sheet material that facilitate separating portions of the blank or substrate of sheet material from one another, or otherwise that indicate optimal separation locations on the blank or substrate. As used herein, the terms "weakened line of severance", "severance line" and "frangible line" each may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines, weakened lines of severance, frangible lines and severance lines can each includes elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a frangible line. The line of perforations can be designed to facilitate folding and resist breaking to provide a fold line, to facilitate folding and facilitate breaking with more effort to provide a frangible fold line, or to facilitate breaking with little effort to provide a frangible line.

The invention claimed is:

1. A carton for packaging one or more articles, the carton comprising a plurality of panels for forming a top wall, a base wall, a first side wall and a second side wall which together form a tubular structure, the plurality of panels also forming a first end wall and a second end wall, wherein the carton comprises an access structure for dispensing said one or more articles, the access structure comprising a first detachable section, defined by a first series of frangible connections, and a second detachable section, defined by a second series of frangible connections, wherein the first detachable section and the second detachable section share a common portion of one of said plurality of panels, wherein the first and second detachable sections are separately detachable, wherein the first detachable section is struck from a first panel and a second panel, the second panel being disposed adjacent to the first panel and wherein the second detachable section is struck from the second panel and a third panel, the second panel being disposed adjacent to the third panel and the third panel being disposed adjacent to the first panel, wherein the first series of frangible connections and the second series of frangible connections share a common severance line or at least a portion thereof.

2. A carton according to claim 1 wherein the access structure comprises at least one tear initiation device for facilitating removal of each of the first and second detachable sections.

3. A blank for forming a carton, the blank comprising a plurality of panels for forming a top wall, a base wall, a first side wall, a second side wall, a first end wall, and a second end wall in a set-up carton, wherein the blank comprises an access structure for dispensing one or more articles, the access structure comprising a first detachable section, defined by a first series of frangible connections, and a second detachable section, defined by a second series of frangible connections, wherein the first detachable section and the second detachable section share a common portion of one of said plurality of panels, wherein the first and second detachable sections are separately detachable, wherein the first detachable section is struck from a first panel and a second panel, the second panel being disposed adjacent to the first panel and wherein the second detachable section is struck from the second panel and a third panel, the second panel being disposed adjacent to the third panel and the third panel being disposed adjacent to the first panel, wherein the first series of frangible connections and the second series of frangible connections share a common severance line or at least a portion thereof.

4. The blank according to claim 3, wherein the second detachable section has a total area that is greater than the area of the first detachable portion.

5. The blank according to claim 3, wherein the second detachable section is formed from material comprised in two adjacent walls of the set-up carton and as such the second series of frangible connections extends into said two adjacent walls of the set-up carton.

6. The blank according to claim 3, wherein the frangible connections of the first series of frangible connections are contiguous with one another and wherein the frangible connections of the second series of frangible connections are contiguous with one another.

7. The blank according to claim 3, wherein the access structure comprises at least one tear initiation device for facilitating removal of each of the first and second detachable sections.

* * * * *